US007686282B2

(12) United States Patent
Amoss et al.

(10) Patent No.: US 7,686,282 B2
(45) Date of Patent: Mar. 30, 2010

(54) HANDLE-OPERATED BRAKE/RELEASE MECHANISM FOR A CABLE DRUM WINCH

(75) Inventors: Robert S. Amoss, New Orleans, LA (US); jun Ren Zeng, ChangShu (CN)

(73) Assignee: Amoss Trading Services, Inc., New Orleans, LA (US)

( * ) Notice: Subject to any disclaimer, the term of this patent is extended or adjusted under 35 U.S.C. 154(b) by 0 days.

(21) Appl. No.: 12/475,980

(22) Filed: Jun. 1, 2009

(65) Prior Publication Data

US 2010/0001243 A1 Jan. 7, 2010

Related U.S. Application Data

(60) Provisional application No. 61/057,438, filed on May 30, 2008.

(51) Int. Cl.
*B66D 1/14* (2006.01)

(52) U.S. Cl. ..... 254/342

(58) Field of Classification Search ..... 254/342, 254/237, 332, 352, 357, 369, 376, 278
See application file for complete search history.

(56) References Cited

U.S. PATENT DOCUMENTS

| | | | | |
|---|---|---|---|---|
| 2,363,138 | A * | 11/1944 | Moore | 254/369 |
| 2,746,718 | A | 5/1956 | French | |
| 2,973,941 | A | 3/1961 | Lunde | |
| 3,141,353 | A | 7/1964 | Gray | |
| 4,004,780 | A * | 1/1977 | Kuzarov | 254/345 |
| 4,045,001 | A * | 8/1977 | Harvey, Jr. | 254/369 |
| 4,106,754 | A | 8/1978 | Kucher | |
| 4,520,998 | A * | 6/1985 | Flaig | 254/267 |
| 5,947,450 | A * | 9/1999 | Grapes | 254/329 |
| 6,431,525 | B1 | 8/2002 | Roll | |
| 6,572,083 | B1 | 6/2003 | Topping, Jr. et al. | |
| 6,971,278 | B2 * | 12/2005 | Robbins et al. | 74/523 |
| 7,128,307 | B2 | 10/2006 | Dow | |
| 7,159,852 | B2 | 1/2007 | Dow et al. | |
| 7,543,800 | B2 * | 6/2009 | Grapes et al. | 254/376 |
| 2006/0169964 | A1 * | 8/2006 | Winter | 254/376 |

* cited by examiner

*Primary Examiner*—Evan H Langdon
(74) *Attorney, Agent, or Firm*—Garvey, Smith, Nehrbass & North, L.L.C.; Seth M. Nehrbass; Charles C. Garvey, Jr.

(57) ABSTRACT

A handle operated brake and release mechanism for a cable drum winch provides a winch that can be used in the assembly of inland river barges to form multi-barge tows. The handle of the brake and release mechanism can in one function and entirely by hand (without using any other tools) release the cable tension and apply the brake at the same time. The entire brake and release mechanism is mounted on the outside of a winch frame having winch side plates, thereby allowing the mechanism parts to be replaceable in the field without taking the winch side plates apart.

18 Claims, 7 Drawing Sheets

HANDLE-OPERATED BRAKE/RELEASE MECHANISM FOR A CABLE DRUM WINCH

CROSS-REFERENCE TO RELATED APPLICATIONS

Priority of U.S. Provisional Patent Application Ser. No. 61/057,438, filed 30 May 2008, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the inland barge industry and, more specifically, to the method of assembling and unassembling multi barge tows.

2. General Background of the Invention

The two mechanisms most commonly used to tie up barges to each other to form a multi-barge tow are manual cable winches and river ratchets combined with chain and cable. Winches are becoming more popular as they are fixed to the barge and do not require the deck hands to bend over to operate.

Barge operators are concerned that the loose gear associated with the river ratchets can be easily lost. There is also concern that the deck hands may injure themselves because they must reach down to the deck level to operate the river ratchet.

Prior art winches have three drawbacks. They employ a difficult and dangerous knock-out method of releasing the winch cable tension. The slow operation of the release is a time-consuming function using separate devices to operate the brake and the release mechanism. The dog assembly is difficult to replace as it is mounted on shafts located between the winch side plates. The dog release of a typical prior art winch must be knocked out using a hammer or a long pole designed to be used as a ratchet extension. Damage to the winch or personal injury can result when the deck hand misses his mark with a large hammer or his extension pole.

There is a need for a winch that can be released easily, quickly and with unassisted human power. The holdback and brake parts can wear out quickly. The holdback gear replacement is difficult as it involves separating the winch side plates. There is a need for these high-wear parts to be easily replaced while in the field.

The following patent documents are incorporated herein by reference: U.S. Pat. Nos. 2,746,718; 2,973,941; 3,141,353; 4,106,754; 6,431,525; 6,572,083; 7,128,307; 7,159,852.

BRIEF SUMMARY OF THE INVENTION

The primary object of the invention is to provide a mechanism for a winch that can be used to easily release the cable tension by pulling a handle that at the same time applies the brake to the cable drum.

The handle, brake and holdback parts should be easily replaceable in the field, not requiring removal of the side plates.

The typical winch (for example a low profile 40 ton manual winch) that is used by barge operators has a horizontal cable drum mounted on a main shaft that is at right angles to the cable pulling direction. One of the drum flanges is the main drum gear. The cable force is reduced by gearing through the drum gear and one or two reduction gears whose shafts parallel the main drum shaft. The drum shaft and gear shaft are held in place by the winch side plates. A holdback gear and brake drum are mounted on the drive shaft end outside of the winch side plate. A holdback dog with one or more teeth engages the holdback gear to hold back against the cable pulling force. The holdback dog and gear are designed to hold only in one direction so that when the drum cable is taken in the dog lifts out of the gear and drops into the next gear tooth.

The holdback dog of the present invention has an extended arm that can be pried out using the mechanical advantage of a handle mounted on a separate handle shaft close to the end of the holdback dog. The handle has two fixed pins whereby one pin acts to pry out the holdback dog and the other pin is set to tension the brake band around the brake drum. By positioning the pins in relation to each other and to the handle shaft, the handle movement can pry out and release the holdback dog just as the brake reaches the maximum holding force. The entire mechanism of the holdback dog, holdback gear, release handle and brake drum is mounted on the outside of the winch side plate so that the parts can be easily replaced without opening the winch side plates.

The parts of a preferred embodiment of the present invention preferably include: a winch holdback dog that has one or more teeth, a holdback pivot shaft and an extended holdback dog arm; an optional bushing to facilitate the rotation of the dog on the holdback shaft; a holdback gear mounted on the drive shaft extension; a holdback release and brake handle rotating on a handle shaft; a handle shaft; and two pins attached to the pry out handle and used for the pry out of the holdback dog and to tension the brake strap around the brake drum; a brake assembly of a drum with the drum attached to the drive shaft end. The brake strap has a tensioner used to adjust the strap tension at the fixed tensioner tab that is welded to the side plate.

The handle has a pin set in such a manner so that it engages the holdback dog extension when the handle is rotated. A second pin on the handle is attached to the brake strap so that as the handle rotates, the brake strap tightens around the brake drum at the same time as the holdback dog is released. Using the mechanical leverage of the extended holdback dog arm and the handle, the fixed pins have sufficient mechanical advantage to manually pry out the holdback dog from the holdback gear while at the same time applying the winch brake.

To give an example of scale, the holdback dog extension arm can be about six inches long.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
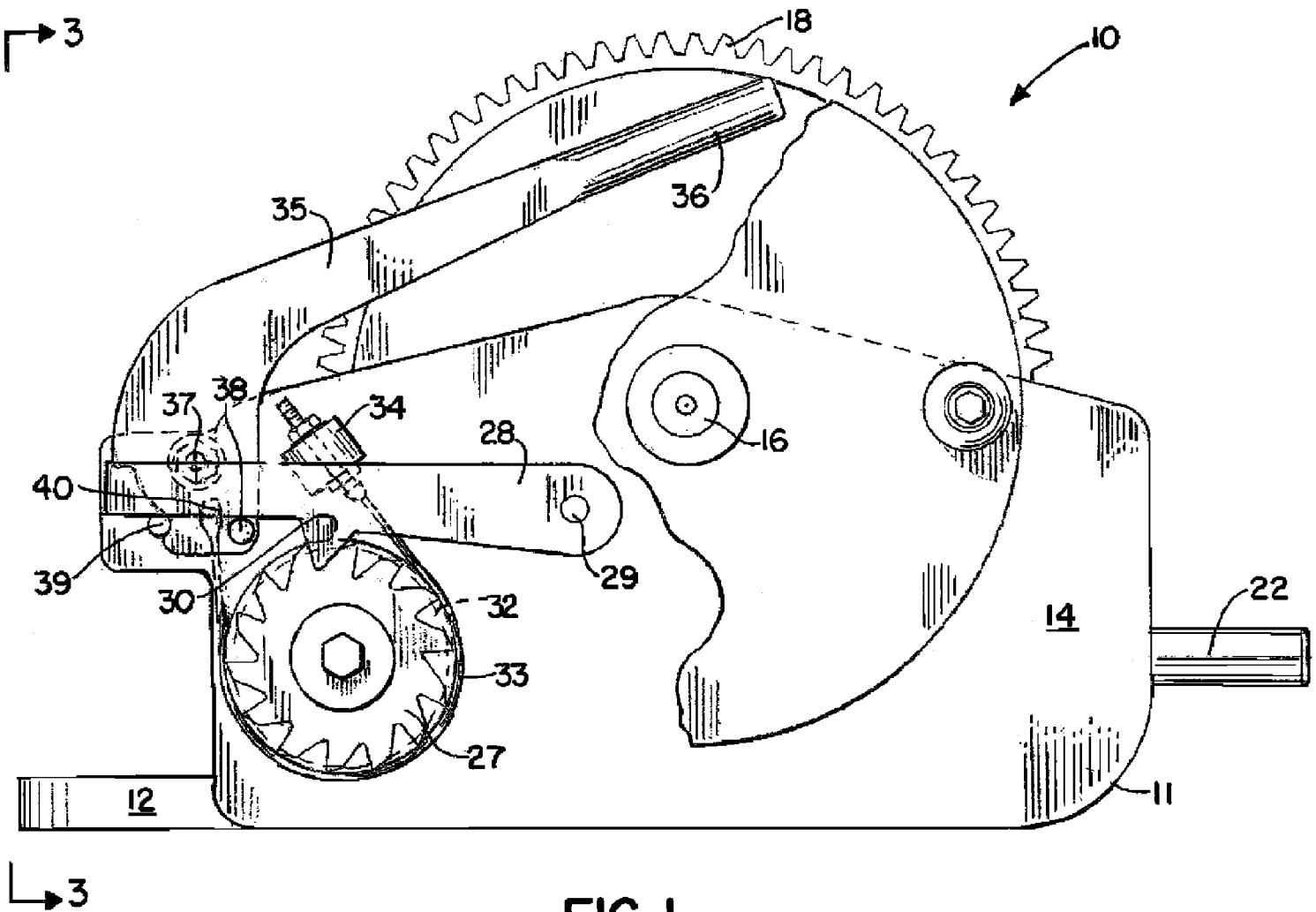
FIG. 1 is a side elevation view of the preferred embodiment of the apparatus of the present invention.
Figure 2:
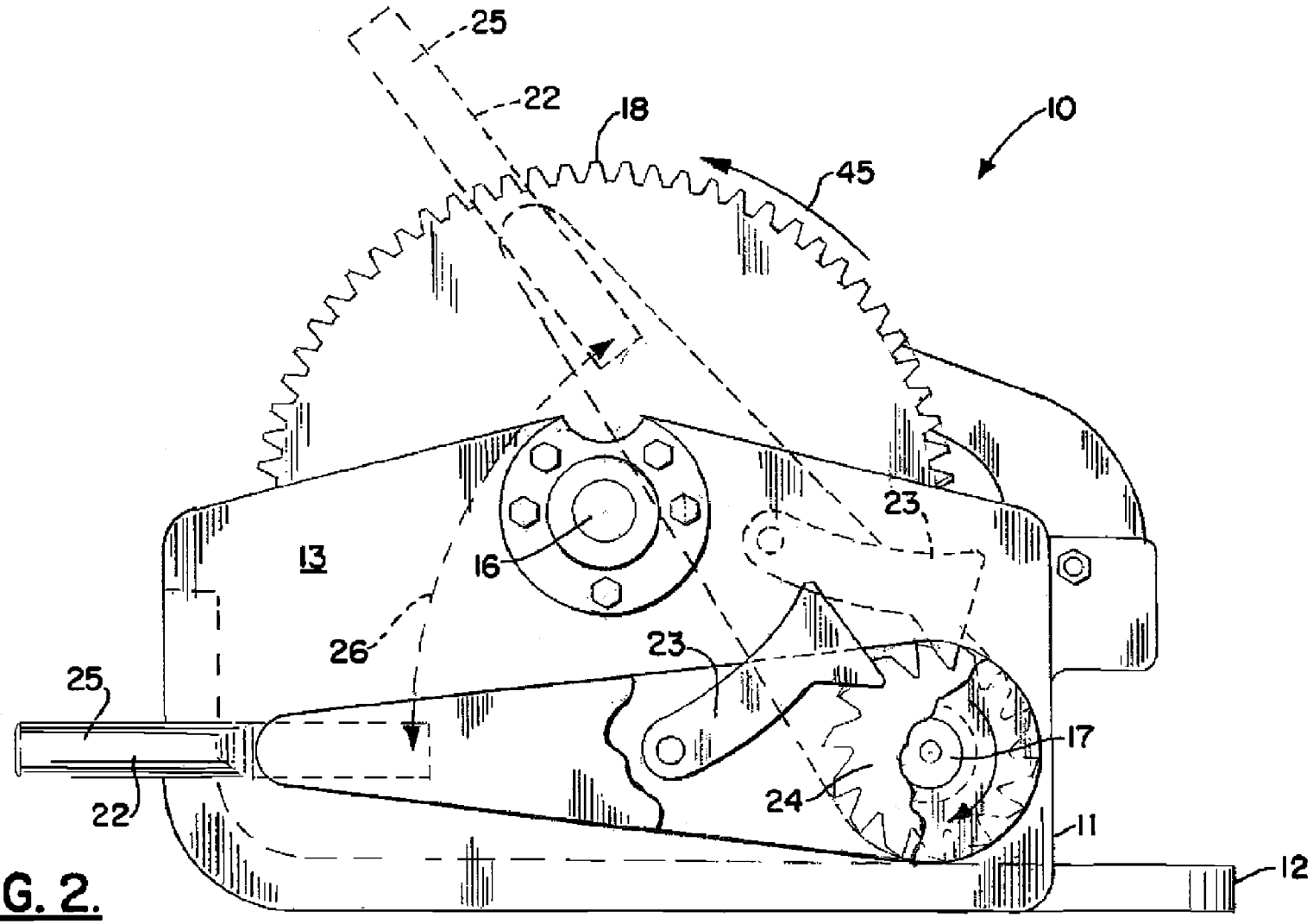
FIG. 2 is a side elevation view of the preferred embodiment of the apparatus of the present invention.

FIGS. 1-7 show the preferred embodiment of the apparatus of the present invention designated generally by the numeral 10. Winch apparatus 10 provides a frame 11 that can include a base 12 and side plates 13, 14. Frame 11 may be made from steel, such as mild steel. Base 12 may be made from steel, such as mild steel. Side plates 13, 14 may be made from steel, such as mild steel; side plates 13, 14 may range in size from about ⅜"-¾" thick and about 18 by 24 inches, for example. The frame 11 supports a main drum or cable drum 15. The cable drum 15 is supported by a drum shaft 16. Cable drum 15 may be made from mild steel or cast steel. and drum shaft 16 may be made from mild steel or heat treated mild or alloy steel. The drum shaft 16 can be supported by the frame 11, and more particularly by the side plates 13, 14 as shown in the drawings.

Figure 3:
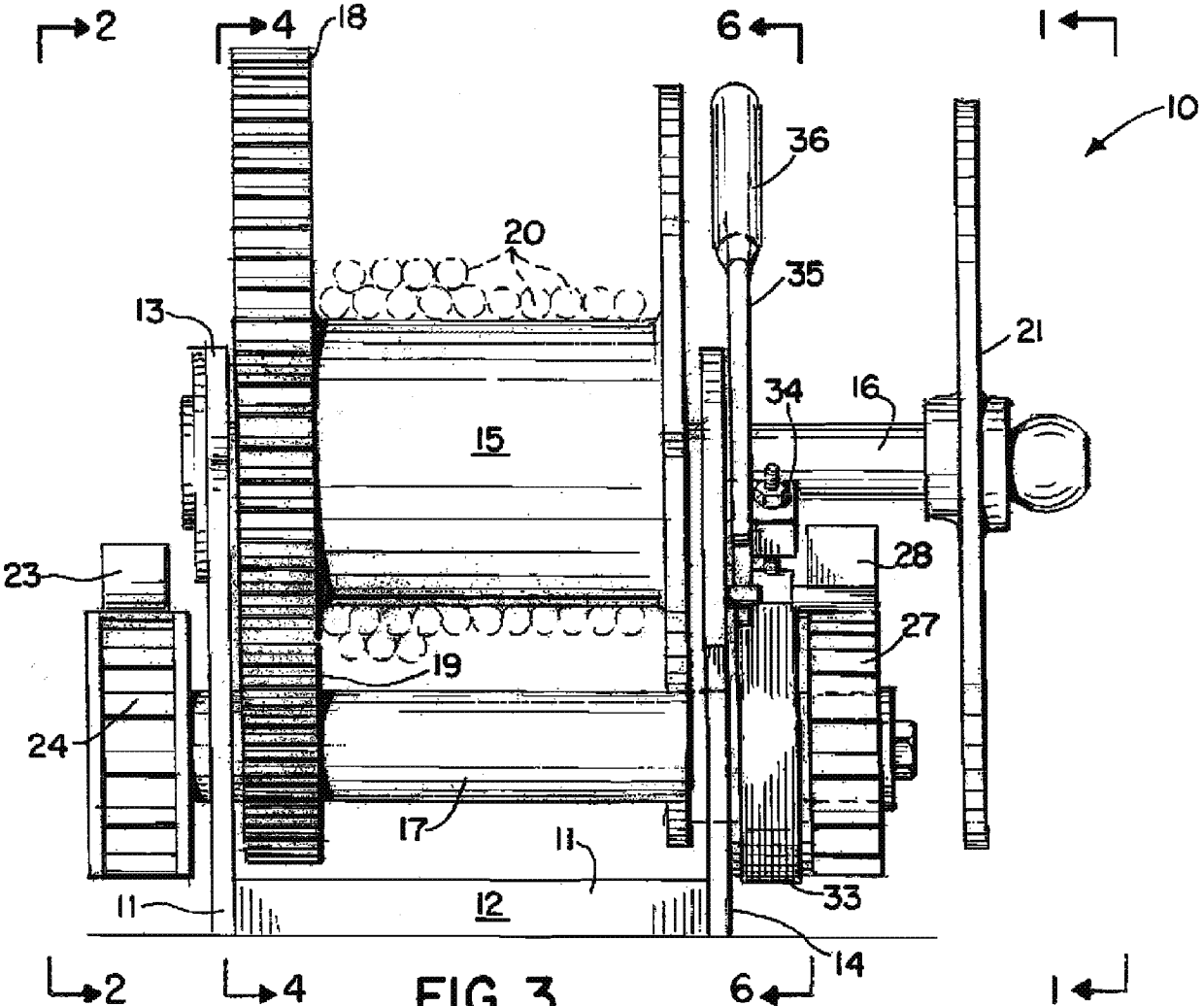
FIG. 3 is an end view taken along lines 3-3 of FIG. 1.
Figure 4:
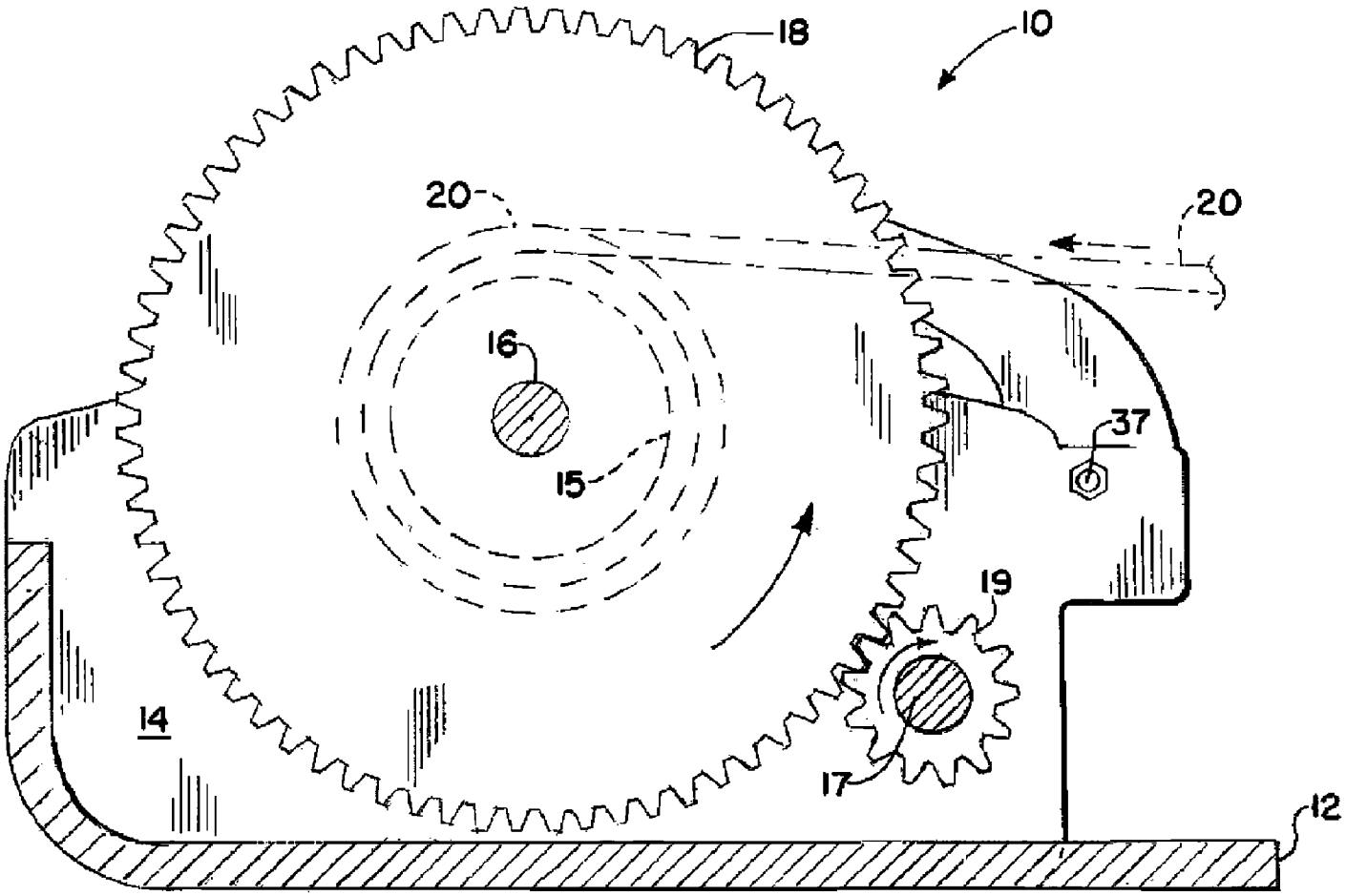
FIG. 4 is a sectional view taken along lines 4-4 of FIG. 3.

The drum 15 can be driven with a drive shaft 17. The drive shaft 17 is also supported by the base 12 and can be supported by side plates 13, 14. The drive shaft 17 carries reduction gear 19. Rotation of the drive shaft 17 rotates the reduction gear 19 which is engaged with drum gear 18 that is affixed to drum 15 as shown in FIG. 3. The main drum or cable drum 15 is preferably wound with an elongated cable 20. Cable 20 may be any commercially available cable such as about ⅞" diameter 6 by 7 or 6 by 19 fibercore wire rope or wire rope core wire rope. Wheel 21 can be provided for quickly spooling cable 20 on drum 15. Once cable 20 is under tension, ratchet 22 can be used to take up cable 20 (as shown by arrow 45). The ratchet 22 is provided with handle 25 and pawl 23. Ratchet 22 rotates drive gear 24 which is mounted on drive shaft 17 as shown in FIG. 3. Ratchet 22 provides handle 25 to be grasped by a user. The user moves handle 25 in the direction of arrow 26 in FIG. 2 to an elevated position (phantom lines) and returns the handle 25 to the lower position shown in hard lines in FIGS. 2-3.

In order to prevent reverse rotation of drive shaft 17, holdback gear 27 is provided on drive shaft 17. The holdback gear 27 is prevented from rotating in a reverse or unwinding direction by tooth 30 of holdback dog 28. Tooth 30 is sized and shaped to engage teeth 31 (see FIG. 5) of holdback gear 27. Holdback gear 27, holdback dog 28, tooth 30 and teeth 31 can be made from hardened steel, such as 1040 steel. Holdback gear 27 can be for example about 5" in diameter.

Figure 6:
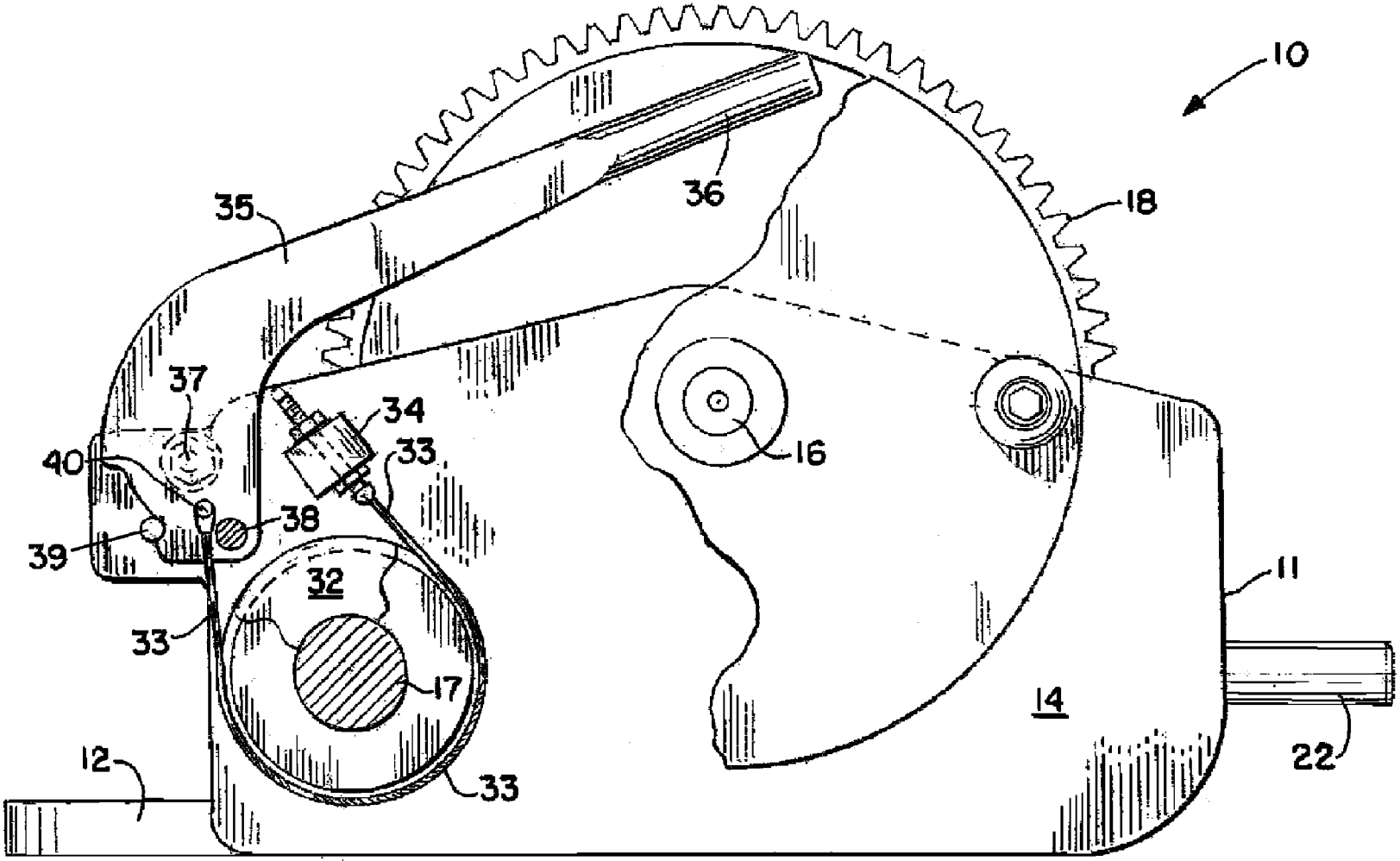
FIG. 6 is a sectional view taken along lines 6-6 of FIG. 3.
Figure 7:
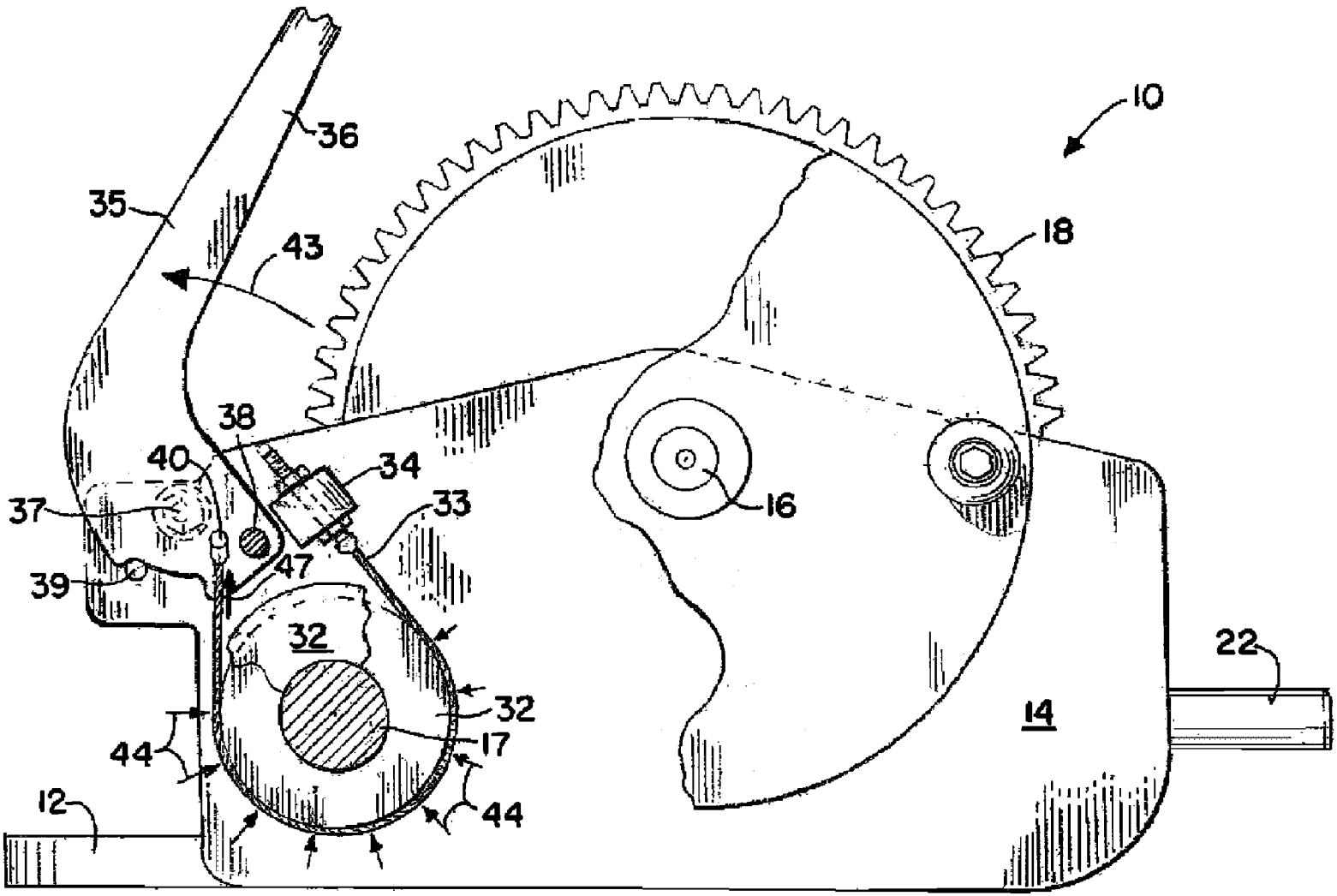
FIG. 7 is a partially broken away side elevation view of the preferred embodiment of the apparatus of the present invention.

The holdback dog 28 is mounted to frame 11 with a pivotal connection 29. The holdback gear 27 provides a plurality of teeth 31 that interlock with tooth 30 of holdback dog 28 as an operator winds cable 20 upon drum 15. Brake drum 32 is mounted next to holdback gear 27 as shown in FIGS. 6 and 7. Brake drum 32 thus is attached to and rotates with drive shaft 17. Brake band 33 is provided for engaging break drum 32 to prevent rotation of drive shaft 17 and thus cable drum 15. Brake band 33 is provided with band adjuster 34 which enables the length of the band 33 to be varied as it extends about drum 32 in the position shown generally in FIGS. 1, 3, and 5-7. Brake band 33 may be made from, for example, a composite of steel, such as stainless steel, and brake material, such as hard rubber or other flexible braking material.

A lever 35 having a handle 36 is pivotally attached to frame 11 at pivotal connection 37. The lever 35 is provided with a plurality of pins 38, 39, 40. The pin 39 is a stop pin that limits pivotal rotation of lever 35 about its pivotal connection 37 as it is moved between the position shown in FIG. 1 and the position shown in FIGS. 5 and 7.

Pin 40 is a pin that is attached to one end portion of brake band 33 as shown in FIGS. 1 and 5-7. The pin 38 is a pin that lifts holdback dog 28 upwardly in the direction of arrow 42 in FIG. 5 when the lever 35 is rotated to an upper position of FIG. 5 (see arrow 41 in FIG. 5).

Figure 5:
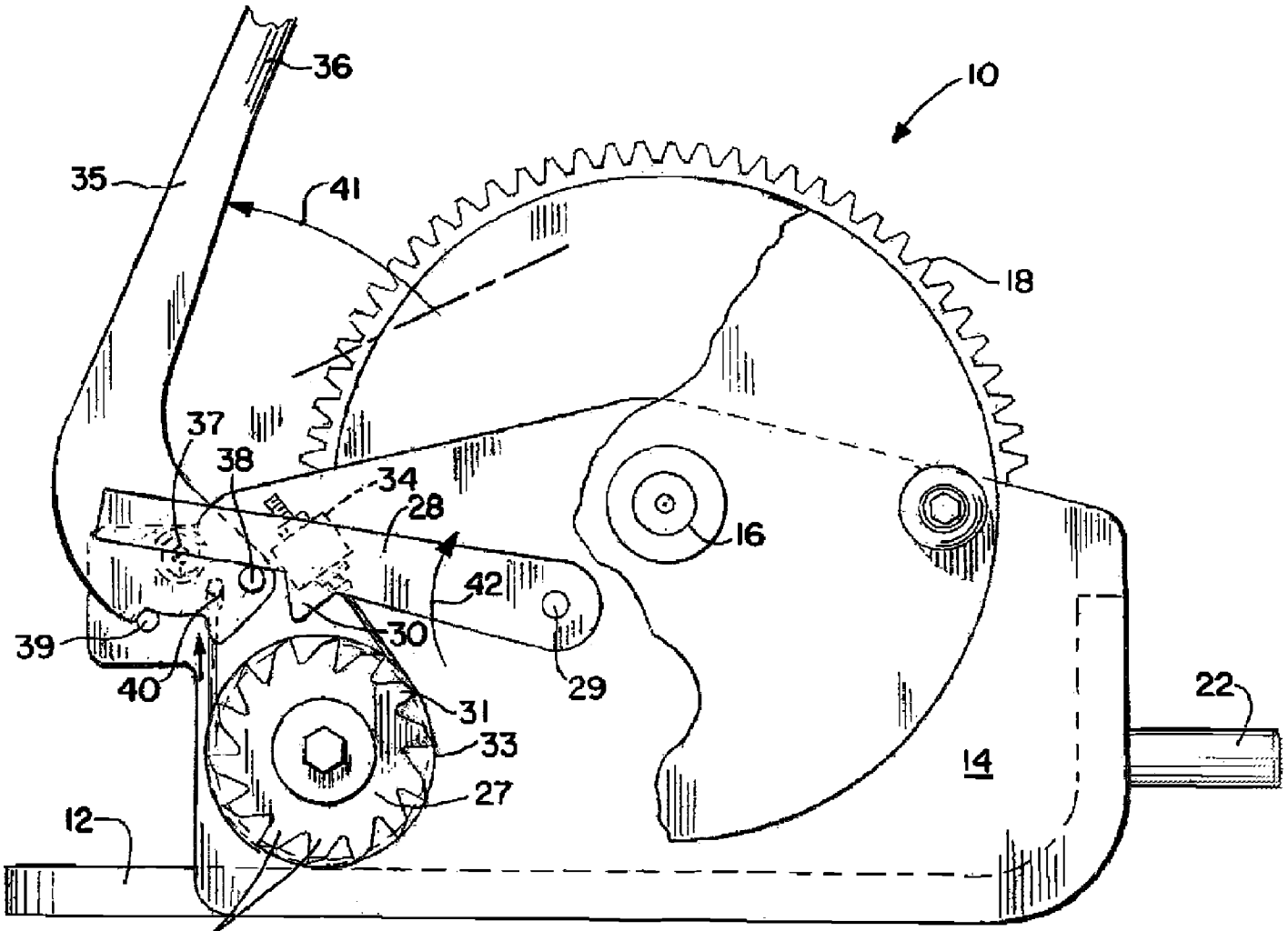
FIG. 5 is a partially broken away side elevation view of the preferred embodiment of the apparatus of the present invention.

In the position of FIG. 5, the tooth 30 of holdback dog 28 has disengaged the teeth 31 of holdback gear 27. The pins 38 and 40 are so positioned that the tooth 30 of holdback dog 28 disengages the teeth 31 of holdback gear 27 as pin 40 travels upwardly and reaches a position that applies tension to brake band 33. This action typically initially diminishes then prevents rotation of drive shaft 17 and cable drum 15. When the tooth 30 disengages the gear teeth 31 of holdback gear 27, drum 15 is prevented from rotating by the tension applied to brake drum 32 with brake band 33. In FIG. 7, arrow 43 illustrates the upward travel of handle 36 of lever 35 to an upper position that also applies maximum tension of band 33 to drum 32 as illustrated schematically by arrows 44 in FIG. 7.

The following is a list of parts and materials suitable for use in the present invention.

PARTS LIST

| Part Number | Description |
|---|---|
| 10 | winch apparatus |
| 11 | frame |
| 12 | base |
| 13 | side plate |
| 14 | side plate |
| 15 | cable drum |
| 16 | drum shaft |
| 17 | drive shaft |
| 18 | drum gear |
| 19 | reduction gear |
| 20 | cable |
| 21 | wheel |
| 22 | ratchet |
| 23 | pawl |
| 24 | drive gear |
| 25 | handle |
| 26 | arrow |
| 27 | holdback gear |
| 28 | holdback dog |
| 29 | pivotal connection |
| 30 | tooth |
| 31 | gear tooth |
| 32 | brake drum |
| 33 | brake band |
| 34 | band adjuster |
| 35 | lever |
| 36 | handle |
| 37 | pivotal connection |
| 38 | pin |
| 39 | pin |
| 40 | pin |
| 41 | arrow |
| 42 | arrow |
| 43 | arrow |
| 44 | arrow |
| 45 | arrow |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A winch apparatus comprising:

a) a frame;

b) a cable drum supported by the frame;

c) a drive shaft mounted on the frame;

d) gearing that enables the drive shaft to rotate the cable drum;

e) a holdback mechanism on the frame that includes a holdback gear and a holdback dog having an extended arm and at least one tooth to engage the holdback gear to hold back against a cable pulling force; and f) a handle mounted on a handle shaft separate from the drive shaft and next to the holdback dog, the handle having two fixed pins, including a first pin that acts to pry out the holdback dog and a second pin that tensions a brake band around a brake drum of the winch, wherein the holdback dog can be pried out using the mechanical advantage of the handle.

2. The winch of claim 1, wherein handle movement pries out and releases the holdback dog as the brake band applies a maximum tension to the brake drum.

3. The winch of claim 1, wherein the frame includes a pair of winch frame side plates and the holdback dog, the holdback gear, the handle and the brake drum is mounted on the outside of one winch side plate enabling replacement without opening either winch side plate.

4. The winch of claim 1, wherein the handle can, in one function, entirely by hand, and without using any other tools, release the holdback dog and tensions the brake band at the same time.

5. The winch of claim 2, wherein the frame includes a pair of winch frame side plates and the holdback dog, the holdback gear, the handle and the brake drum form a brake and release mechanism and the brake and release mechanism is mounted on the outside of one winch side plate of the winch enabling replacement without opening either winch side plate.

6. The winch of claim 5, wherein parts of the brake and release mechanism can be easily replaced without opening either winch side plate.

7. The winch of claim 1, wherein the drive shaft is positioned below a drum shaft.

8. The winch of claim 1, wherein the holdback gear and the brake drum are mounted on a common shaft.

9. The winch of claim 8, wherein the common shaft is the drive shaft.

10. A winch apparatus comprising:

a) a frame;

b) a cable drum supported by the frame;

c) a drive shaft mounted on the frame;

d) gearing that enables the drive shaft to rotate the cable drum;

e) a holdback mechanism on the frame that includes a holdback gear and a holdback dog having an extended arm and at least one tooth to engage the holdback gear to hold back against a cable pulling force; and f) a handle mounted on a handle shaft separate from the drive shaft and next to the holdback dog, the handle having two fixed pins, including a first pin that acts to pry out the holdback dog and a second pin that tensions a brake band around a brake drum of the winch, wherein the holdback dog can be pried out using the mechanical advantage of the handle, and handle movement both releases the hold back dog and simultaneously tightens the brake band around the brake drum.

11. The winch of claim 10, wherein handle movement pries out and releases the holdback dog as the brake band applies a maximum tension to the brake drum.

12. The winch of claim 10 wherein the frame includes a pair of winch frame side plates and the holdback dog, the holdback gear, the handle and the brake drum is mounted on the outside of one winch side plate enabling replacement without opening either winch side plate.

13. The winch of claim 10, wherein the handle can, in one function, entirely by hand, and without using any other tools, release the holdback dog and tensions the brake band at the same time.

14. The winch of claim 11, wherein the frame includes a pair of winch frame side plates and the holdback dog, the holdback gear, the handle and the brake drum form a brake and release mechanism and the brake and release mechanism is mounted on the outside of one winch side plate of the winch enabling replacement without opening either winch side plate.

15. The winch of claim 14, wherein parts of the brake and release mechanism can be easily replaced without opening either winch side plate.

16. The winch of claim 10, wherein the drive shaft is positioned below a drum shaft.

17. The winch of claim 10, wherein the holdback gear and the brake drum are mounted on a common shaft.

18. The winch of claim 17, wherein the common shaft is the drive shaft.

* * * * *